US011330924B2

(12) United States Patent
McKay et al.

(10) Patent No.: US 11,330,924 B2
(45) Date of Patent: May 17, 2022

(54) DEVICE AND METHOD FOR AIDING PUTTING ON A SKI BOOT

(71) Applicants: Kelly McKay, Holmdel, NJ (US); Amanda Batchelor, McCall, ID (US); Jessica Hendricks, Colorado Springs, CO (US)

(72) Inventors: Kelly McKay, Holmdel, NJ (US); Amanda Batchelor, McCall, ID (US); Jessica Hendricks, Colorado Springs, CO (US)

( * ) Notice: Subject to any disclaimer, the term of this patent is extended or adjusted under 35 U.S.C. 154(b) by 1258 days.

(21) Appl. No.: 15/372,298

(22) Filed: Dec. 7, 2016

(65) Prior Publication Data

US 2017/0156529 A1 Jun. 8, 2017

Related U.S. Application Data

(60) Provisional application No. 62/263,911, filed on Dec. 7, 2015.

(51) Int. Cl.

| | |
|---|---|
| ***A47G 25/80*** | (2006.01) |
| ***A43B 11/00*** | (2006.01) |
| ***A43B 5/04*** | (2006.01) |

(52) U.S. Cl.

CPC ..... *A47G 25/80* (2013.01); *A43B 5/0415* (2013.01); *A43B 11/00* (2013.01)

(58) Field of Classification Search

CPC ..... A47G 25/80; A47G 25/82; A47G 25/84; A47G 25/90; A47G 25/905; A43B 5/04515; A43B 11/00; A43B 5/0415; A43B 5/04; A43B 5/0411; A43B 11/02

See application file for complete search history.

(56) References Cited

U.S. PATENT DOCUMENTS

| | | | | | |
|---|---|---|---|---|---|
| 1,139,144 | A * | 5/1915 | Thomas | A47G 25/80 | 223/113 |
| 4,774,775 | A * | 10/1988 | Pruitt | A43B 5/0419 | 36/117.4 |
| 5,036,552 | A * | 8/1991 | Deakyne | A47G 25/905 | 2/326 |
| 5,285,939 | A * | 2/1994 | Hogan | A43B 5/0425 | 224/602 |

(Continued)

FOREIGN PATENT DOCUMENTS

| | | | | |
|---|---|---|---|---|
| GB | 2316600 | A * | 3/1998 | A47G 25/905 |

*Primary Examiner* — Ismael Izaguirre

(74) *Attorney, Agent, or Firm* — Porzio Bromberg & Newman P.C.

(57) ABSTRACT

A device for aiding putting on a ski boot includes a flexible attachment member removably attached to the ski boot. The flexible attachment member includes a strap retention member at a front end. An end of a main strap is attached at a rear end of the flexible retention member. The other end of the main strap is threaded through the strap retention member and through a loop positioned on a tongue of the ski boot. The main strap is pulled to move the tongue toward the front of the ski boot to increase the opening into the ski boot. After the tongue is in an open position, the ends of the main strap are attached to one another to keep the tongue in an open position. A pair of side straps attached to the main strap can be pulled upwardly on either side of the ski boot to aid in pulling the ski boot onto the foot of the wearer.

18 Claims, 6 Drawing Sheets

(56) References Cited

U.S. PATENT DOCUMENTS

| | | | | |
|---|---|---|---|---|
| 5,289,956 | A * | 3/1994 | Petrou | A47G 25/485 223/85 |
| 5,655,693 | A * | 8/1997 | Engelman | A47G 25/82 223/118 |
| 6,409,692 | B1 * | 6/2002 | Covey | A61F 5/0111 602/5 |
| 9,332,869 | B1 * | 5/2016 | Beaudette | A47G 25/80 |
| 2006/0113147 | A1 * | 6/2006 | Harris, Jr. | A62B 35/0093 182/3 |
| 2011/0088283 | A1 * | 4/2011 | Berthet et al. | A43C 11/008 36/50.1 |
| 2015/0313318 | A1 * | 11/2015 | Gibb | A43C 7/00 36/58.5 |
| 2017/0156529 | A1 * | 6/2017 | McKay | A47G 25/80 |

* cited by examiner

DEVICE AND METHOD FOR AIDING PUTTING ON A SKI BOOT

BACKGROUND OF THE INVENTION

1. Field of the Invention

The present invention relates to a sports device, and more particularly to a device for aiding putting on a ski boot.

2. Description of Related Art

Ski boots typically include a tongue and an opening for receiving a foot of a wearer. The tongue and opening have padding for comfort of the wearer. The ski boots have a tight fit for providing support during skiing. Typically, the tongue is moved forward by the user manually to provide a larger opening for insertion of the wearer's foot. It can be difficult and time consuming for a wearer to move the tongue a sufficient distance to allow the wearer to insert their foot into the opening of the ski boot. It is desirable to provide a device for aiding a wearer to put on ski boots.

SUMMARY OF THE INVENTION

The present invention relates to a device for aiding putting on a ski boot which can be expeditiously and removably attached to the ski boot. A flexible attachment member can be removably attached to the ski boot. The flexible attachment member includes a strap retention member. A main strap has a first end attached to the flexible attachment member. The flexible attachment member can be received around the ski boot to have the end of the main strap attached to the flexible attachment member at the rear of the ski boot and the strap retention member at the front of the ski boot.

A second end of the main strap is threaded through the strap retention member and through a loop positioned on a tongue of the ski boot. The main strap is pulled to move the tongue toward the front of the ski boot to increase the opening into the ski boot. After the tongue is in an open position, the second end of the main strap is pulled toward the rear of the boot and attached to the first end of the main strap. In one, embodiment, the first and second ends of the main strap include an adjacent portion of a hook and loop material for removably attaching the second end of the strap to the first end of the strap once the tongue is in the open position in order to hold the tongue in an open position.

In one embodiment, a pair of side straps are coupled or attached to the main strap. After the tongue is in the open position and the first and second ends of the main strap are secured, the side straps can be pulled upwardly to aid in pulling the ski boot onto the foot of the wearer. The side straps can be positioned near the center of the ski boot or towards the front end of the ski boot for providing maximum force for a wearer pulling upwardly to move the ski boot onto the foot. The side straps can include loops at various locations along the length of the strap to enable grips at different heights.

The invention will be more fully described by reference to the following drawings.

DETAILED DESCRIPTION

Figure 1:
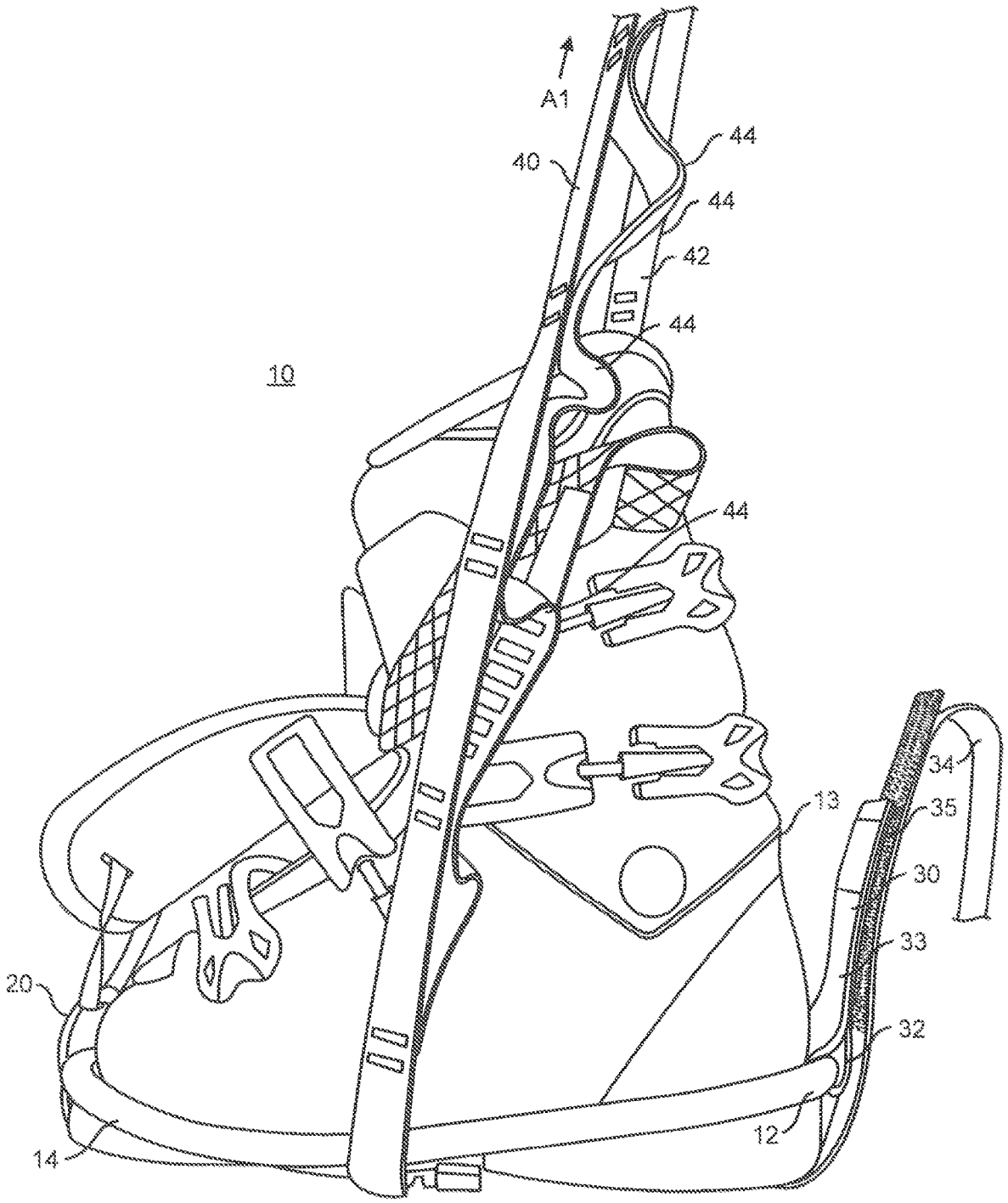
FIG. 1 is a perspective view of device for aiding putting on ski boots after being attached to a ski boot in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
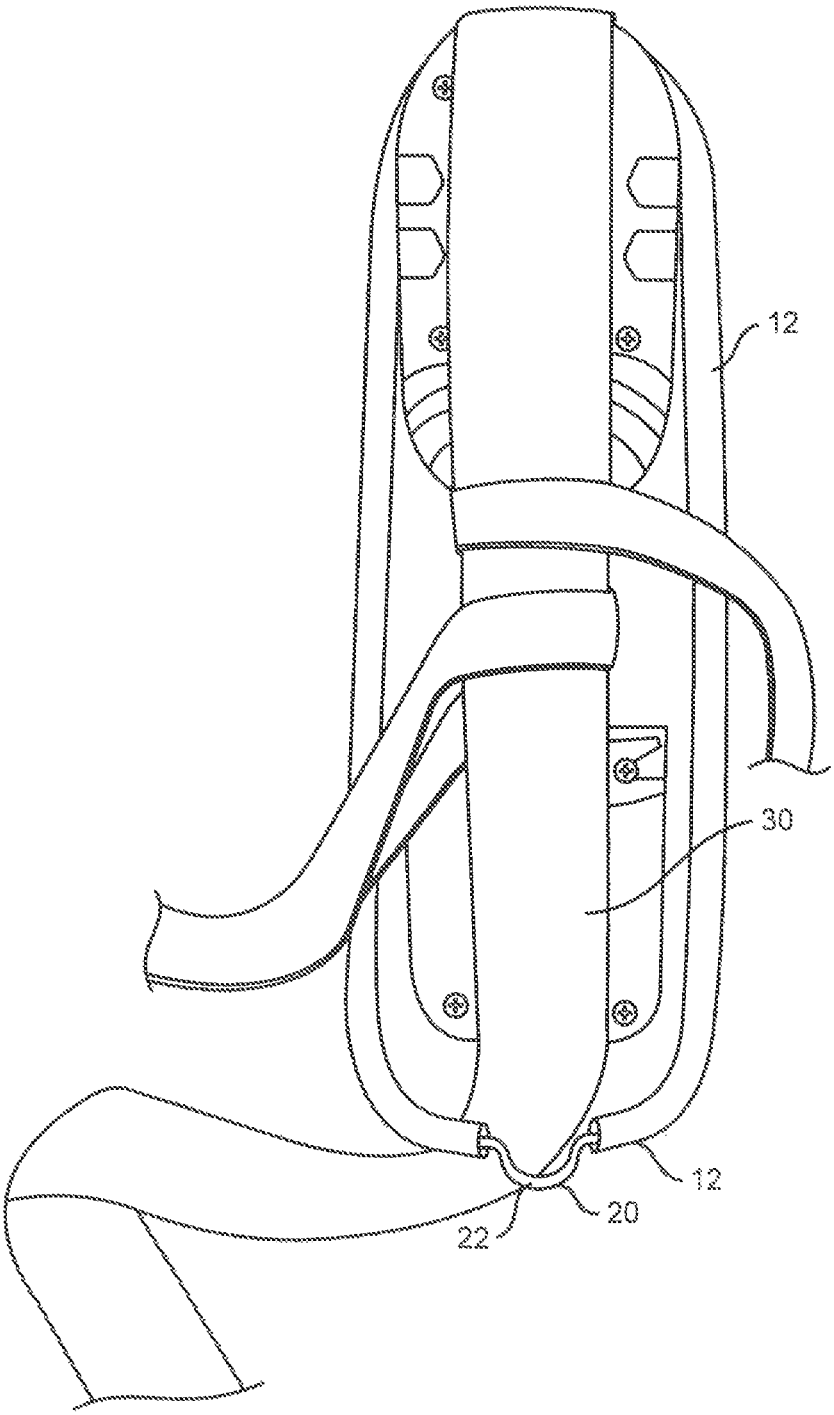
FIG. 2 is a bottom view of the device shown in FIG. 1.

Device for aiding putting on ski boots 10 includes flexible attachment member 12 as shown in FIGS. 1 and 2. Flexible attachment member 12 can be formed of a rubber material. Flexible attachment member 12 can be stretched to be received over a sole of ski boot 13 and retain flexible attachment member 12 adjacent lip 14 of ski boot 13. For example, flexible attachment member 12 can be formed of a bungie cord.

Strap retention member 20 can be coupled or integral with flexible attachment member 12. In one embodiment, strap retention member 20 has a U-shape 22. Suitable materials for strap retention member 20 include metal and plastic.

Main strap 30 has first end 32 attached to flexible attachment member 12. First end 32 can include coupling portion 33 adjacent to first end 32. Second end 34 of main strap 30 can include coupling portion 35 adjacent second end 34. Coupling portion 33 and coupling portion 35 can be made of a hook and loop material such as Velcro.

Figure 3:
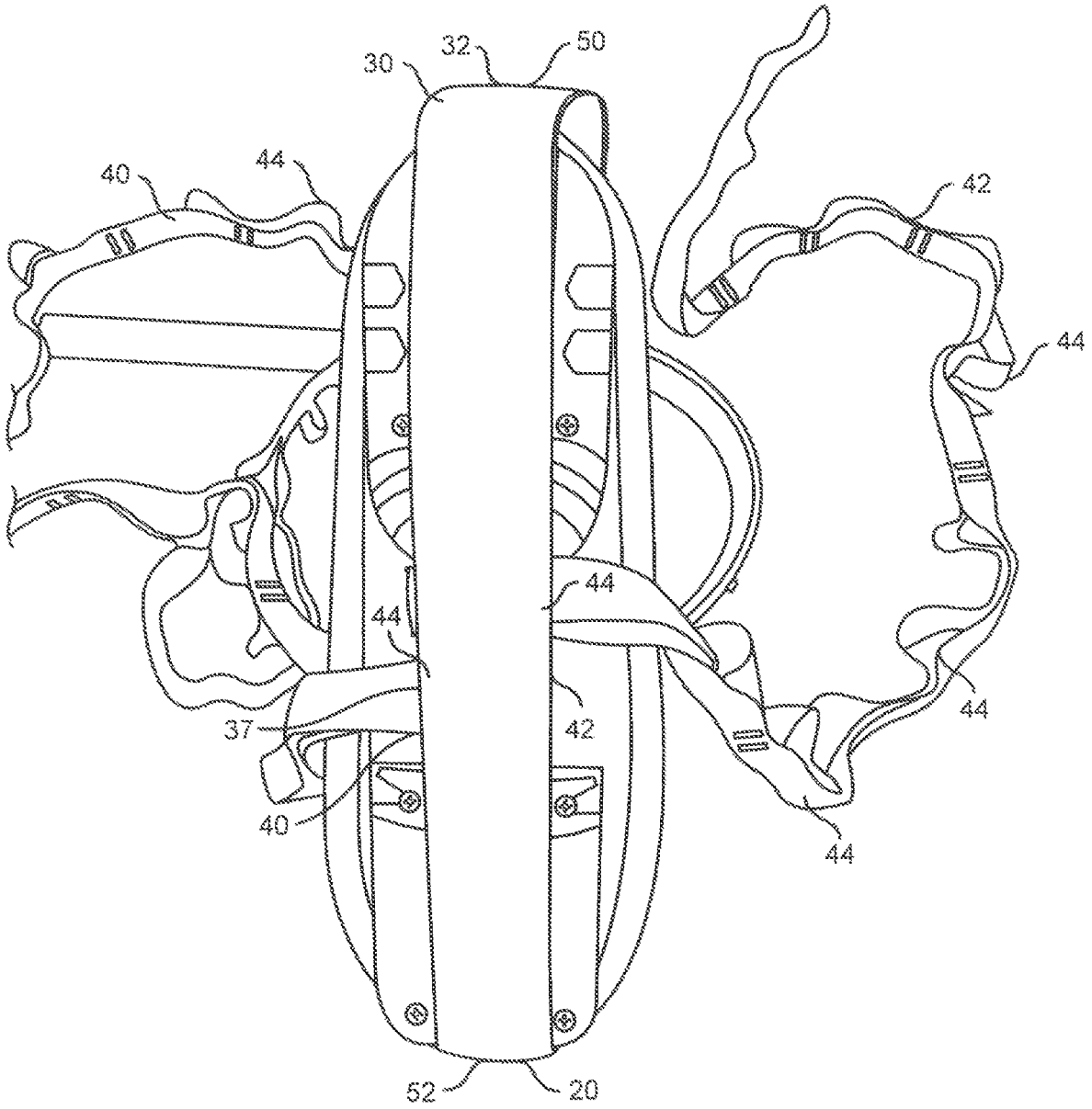
FIG. 3 is a view of the device including side straps.

Side straps 40, 42 can be coupled to main strap 30 as shown in FIG. 3. In one embodiment, side straps 40, 42 are removably attached with coupling portion 44 to coupling portion 37 of main strap 30. Alternatively, side straps 40, 42 can be permanently coupled to main strap 30 such as by sewing or gluing. Side straps 40, 42 are coupled to main strap 30 at a distance from first end such that during use side straps 40, 42 will be positioned near or at the center of ski boot 13 or closer to front 52 of ski boot 13. Side straps 40, 42 can include loops 44 at positions along the length of side straps 40, 42.

Figure 4:
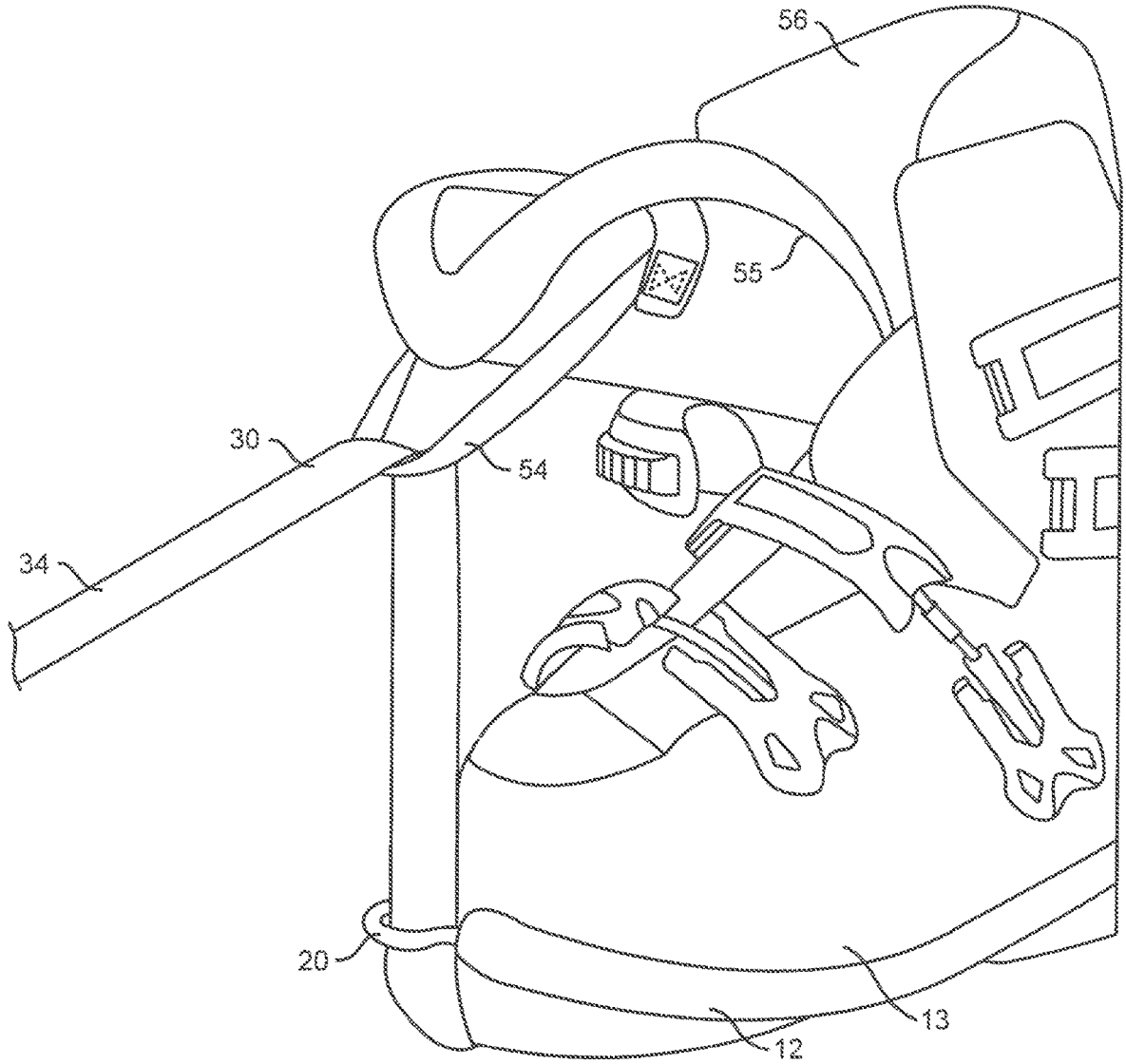
FIG. 4 is a view after threading of the main strap into the strap retention member and during pulling on the main strap to move the tongue into an open position.
Figure 5:
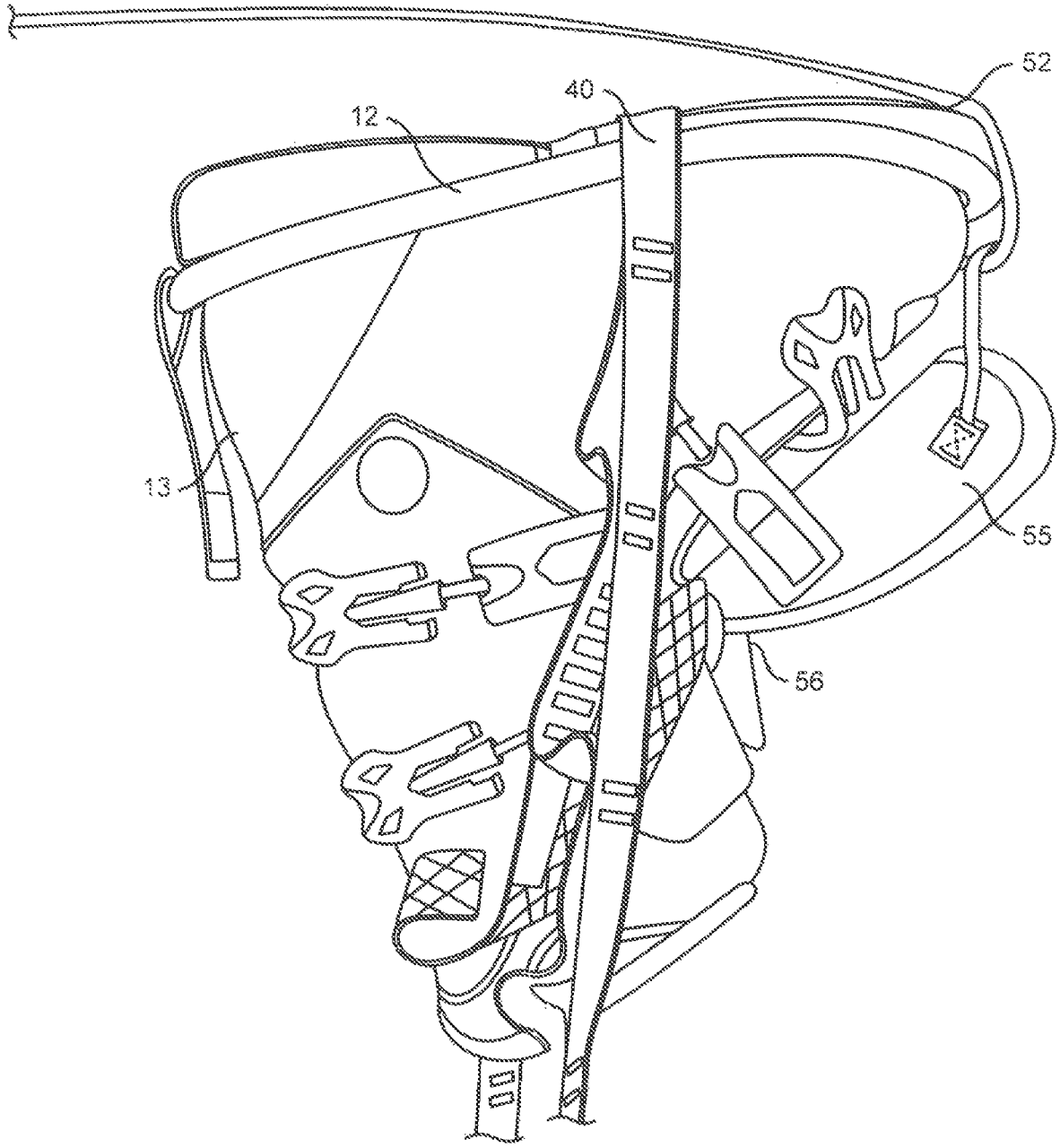
FIG. 5 is a view during movement of a second end of the main strap to a first end of the main strap attached to a flexible attachment member.
Figure 6:
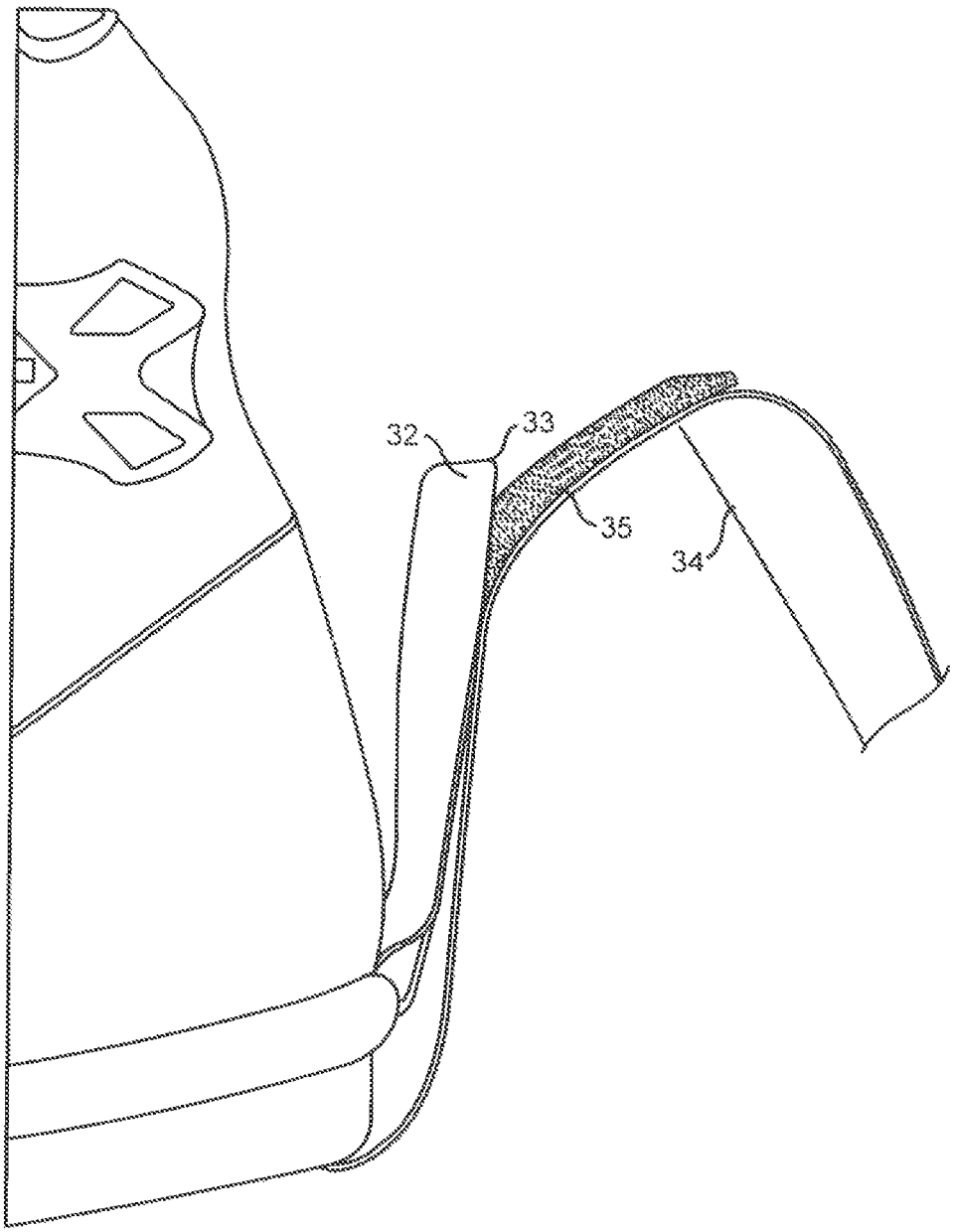
FIG. 6 is a view during attachment of the second end of the main strap to the first end of the main strap.

During use, flexible attachment member 12 can be received around ski boot 13 such that first end 32 of main strap 30 attached to flexible attachment member 12 is positioned at rear 50 of ski boot 13 and strap retention member 12 is positioned at front 52 of ski boot 13 as shown in FIG. 3. Second end 34 of main strap 30 is threaded through strap retention member 20 and through loop 54 positioned on tongue 55 of ski boot 13 as shown in FIG. 4. Second end 32 of main strap 30 is pulled toward rear 52 of ski boot 13 to move tongue 55 toward front 52 of ski boot 13 to increase opening 56 into ski boot 13 as shown in FIG. 5. After tongue 55 is in an open position, coupling portion 35 of second end 34 of main strap 30 is attached to coupling portion 33 of first end 32 for retaining tongue 55 in an open position as shown in FIG. 6.

Referring to FIG. 1, after tongue 55 is in the open position and first end 32 and second end 34 of main strap 30 are secured, side straps 40, 42 can be pulled upwardly in the direction of arrow A1 to aid in pulling ski boot 13 onto the foot of the wearer. In one embodiment one of loops 44 is pulled on by the wearer in order to move ski boot 13 towards the foot.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A device configured to aid putting on a ski boot comprising:

a flexible attachment member;

a strap retention member associated with the flexible attachment member;

a main strap having a first end attached to the flexible attachment member and a second end of the main strap being received in the strap retention member, a first attachment area on said first end and a second attachment area on said second end, the first attachment member and the second attachment member are formed of a hook or loop material, wherein the flexible attachment member is configured to be received over a sole of a ski boot, the first end of the main strap is configured to be placed adjacent a rear of the ski boot, the second end of the main strap is threaded through the strap retention member and the second end of the main strap is configured to be threaded through a loop positioned on a tongue of the ski boot and the main strap is configured to be pulled to move the tongue toward the front of the ski boot to increase the opening into the ski boot the second end of the main strap is pulled toward the rear of the boot and the first attachment area is attached to the second attachment area.

2. The device configured to aid putting on a ski boot of claim 1 wherein the strap retention member has a U-shape.

3. The device configured to aid putting on a ski boot of claim 2 wherein the strap retention member is formed of metal and plastic.

4. The device configured to aid putting on a ski boot of claim 2 wherein the strap retention member is formed of plastic.

5. The device configured to aid putting on a ski boot of claim 1 further comprising a pair of side straps each coupled to the main strap at a distance from the first end such that during use the side straps are configured to be positioned near or at the center of the ski boot or closer to front the front of the ski boot.

6. The device configured to aid putting on a ski boot of claim 5 wherein the side straps are removable attached with first coupling portions to attach to a second coupling portion of the main strap.

7. The device configured to aid putting on a ski boot of claim 5 wherein the side straps are permanently coupled to the main strap.

8. The device configured to aid putting on a ski boot of claim 5 wherein the side straps include loops at positions along the length of the side straps.

9. A device configured to aid putting on a ski boot comprising:

a flexible attachment member;

a strap retention member associated with the flexible attachment member;

a main strap having a first end attached to the flexible attachment member and a second end of the main strap being received in the strap retention member wherein the flexible attachment member is formed of a bungee cord and wherein the flexible attachment member is configured to be received over a sole of a ski boot, the first end of the main strap is configured to be placed adjacent a rear of the ski boot, the second end of the main strap is threaded through the strap retention member and the second end of the main strap is configured to be threaded through a loop positioned on a tongue of the ski boot and the main strap is configured to be pulled to move the tongue toward the front of the ski boot to increase the opening into the ski boot.

10. The device configured to aid putting on a ski boot of claim 9 wherein the strap retention member has a U-shape.

11. The device configured to aid putting on a ski boot of claim 9 further comprising a pair of side straps each coupled to the main strap at a distance from the first end such that during use the side straps are configured to be positioned near or at the center of the ski boot or closer to front the front of the ski boot.

12. The device configured to aid putting on a ski boot of claim 11 wherein the side straps are removable attached with first coupling portions to attach to a second coupling portion of the main strap.

13. The device configured to aid putting on a ski boot of claim 11 wherein the side straps are permanently coupled to the main strap.

14. The device configured to aid putting on a ski boot of claim 11 wherein the side straps include loops at positions along the length of the side straps.

15. A method for aiding putting on a ski boot comprising the steps of:

attaching a flexible attachment member around a ski boot, a strap retention member associated with the flexible attachment member being positioned at a front of the ski boot;

attaching a first end of a main strap to the flexible attachment member at a rear of the ski boot;

threading a second end of the main strap through the strap retention member and through a loop positioned on a tongue of the ski boot and a second end of the main strap is pulled toward the rear of the ski boot to move the tongue toward the front of the ski boot to increase an opening into the ski boot.

16. The method of claim 15 wherein after the tongue is in an open position, further comprising the step of coupling a portion of the second end of the main strap to a coupling portion of the first end for retaining the tongue in an open position.

17. The method of claim 16 further comprising pulling upwardly on side straps attached to the main strap to aid in pulling the ski boot onto the foot of the wearer.

18. The method of claim 17 wherein the side straps include one or more loops which may be grasped in the step of pulling upwardly on the side straps.

* * * * *